US008985999B2

(12) United States Patent
Sherrow et al.

(10) Patent No.: US 8,985,999 B2
(45) Date of Patent: Mar. 24, 2015

(54) FUEL/AIR FURNACE MIXER

(71) Applicant: Trane International Inc., Piscataway, NJ (US)

(72) Inventors: Lester D. Sherrow, Mukwonago, WI (US); Jeffery Wayne O'Daniel, Quitman, TX (US); Deepak Veettil, Tyler, TX (US); Wayne Kraft, Tyler, TX (US)

(73) Assignee: Trane International Inc., Piscataway, NJ (US)

( * ) Notice: Subject to any disclaimer, the term of this patent is extended or adjusted under 35 U.S.C. 154(b) by 0 days.

(21) Appl. No.: 13/745,218

(22) Filed: Jan. 18, 2013

(65) Prior Publication Data

US 2014/0202443 A1 Jul. 24, 2014

(51) Int. Cl.

| | |
|---|---|
| ***F24H 9/00*** | (2006.01) |
| ***F24H 3/02*** | (2006.01) |
| ***F24H 3/06*** | (2006.01) |
| *F24D 5/02* | (2006.01) |

(52) U.S. Cl.

CPC ..... *F24H 9/0068* (2013.01); *F24D 5/02* (2013.01); *F24H 3/025* (2013.01); *F24H 3/065* (2013.01)

USPC ..... 431/12; 431/18; 431/255; 431/280; 126/116 R

(58) Field of Classification Search

CPC ..... F23D 14/02; F23D 14/04; F23D 14/62; F23D 14/64; F23D 14/70; F23D 2201/20; F23D 14/32; F23D 11/40; F23D 2900/00003; F23D 23/00; F23L 7/007; F23L 2900/07002; F23L 17/00; F23L 17/08; F23L 1/02; F23C 6/02; F23C 7/002; F23C 7/004; F23N 1/02; F23N 1/007; F24H 9/2085; F24H 3/087; F24H 9/0068; F24H 9/0057; F23H 9/0057

USPC ..... 431/12, 18, 74, 255, 280; 126/116 R; 165/145

See application file for complete search history.

(56) References Cited

U.S. PATENT DOCUMENTS

| | | | | |
|---|---|---|---|---|
| 3,612,737 | A | 10/1971 | Sharan | |
| 3,721,387 | A | 3/1973 | Wilmot, Jr. | |
| 3,723,049 | A | 3/1973 | Juricek | |
| 3,980,233 | A | 9/1976 | Simmons et al. | |
| 5,292,244 | A | 3/1994 | Xiong | |
| 5,997,285 | A * | 12/1999 | Carbone et al. | 431/354 |
| 2012/0247444 | A1 * | 10/2012 | Sherrow et al. | 126/116 R |

* cited by examiner

*Primary Examiner* — Alfred Basichas
(74) *Attorney, Agent, or Firm* — Conley Rose, P.C.; J. Robert Brown, Jr.; Michael J. Schofield

(57) ABSTRACT

A heating, ventilation, and/or air conditioning (HVAC) furnace has a venturi premixer and a disturber disposed downstream relative to the premixer and in an undivided output of the venturi premixer.

17 Claims, 13 Drawing Sheets

FUEL/AIR FURNACE MIXER

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) furnaces are widely used in commercial and residential environments for heating and otherwise conditioning interior spaces. To reduce emissions, HVAC furnaces may premix fuel/air completely prior to combustion. To help achieve this, HVAC furnaces sometimes comprise a premixer, such as a venturi premixer used to mix air and fuel prior to combustion. Some premixers may be designed for efficiently mixing fuel/air while also minimizing both pressure losses and the size of the premixer. In some furnaces, the air-fuel mixture outputted by the premixer may not be mixed to an effective level to provide for efficient burning of the air-fuel mixture.

SUMMARY

In some embodiments of the disclosure, a heating, ventilation, and/or air conditioning (HVAC) furnace is disclosed as comprising a venturi premixer and a disturber disposed downstream relative to the premixer and in an undivided output of the venturi premixer.

In other embodiments of the disclosure, a receiving tube for a furnace is disclosed as comprising a flowspace disposed within the receiving tube and a disturber at least partially disposed within the flowspace wherein the flowspace is configured to be at least one of (1) directly connected to an output of a venturi premixer and (2) substantially enveloping an output of a venturi premixer, and wherein the receiving tube is configured to allow passage of fluid therethrough in an undivided flowpath.

In yet other embodiments of the disclosure, a method of operating a heating, ventilation, and/or air conditioning (HVAC) furnace is disclosed as comprising mixing air and fuel using a venturi to generate an air-fuel mixture, outputting the air-fuel mixture from the venturi into a receiving tube along an undivided flowpath, disturbing the air-fuel mixture using a disturber disposed within the interior of the receiving tube, and outputting the disturbed air-fuel mixture from the venturi along the undivided flowpath.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Effectively mixing air and fuel in a furnace prior to combustion may be accomplished by disposing a disturber downstream of the furnace's premixer. It may be desirable to further mix the air-fuel mixture downstream of the premixer in order to allow for a more complete combustion of the mixture that may result in relatively lower emissions. Accordingly, a furnace with a disturber located downstream of the premixer for more effectively mixing the air-fuel mixture is provided. The disturber may be configured to shape a velocity distribution of the air-fuel mixture in order to more evenly distribute the air-fuel mixture downstream. The furnace may comprise one or more premixers, each having one or more disturbers located downstream therefrom. A post-combustion chamber may be disposed downstream of the premixer and disturber for distributing the air-fuel mixture to a plurality of outputs. A heat exchanger tube may be located downstream of each outlet for receiving the air-fuel mixture after combustion.

Figure 1:
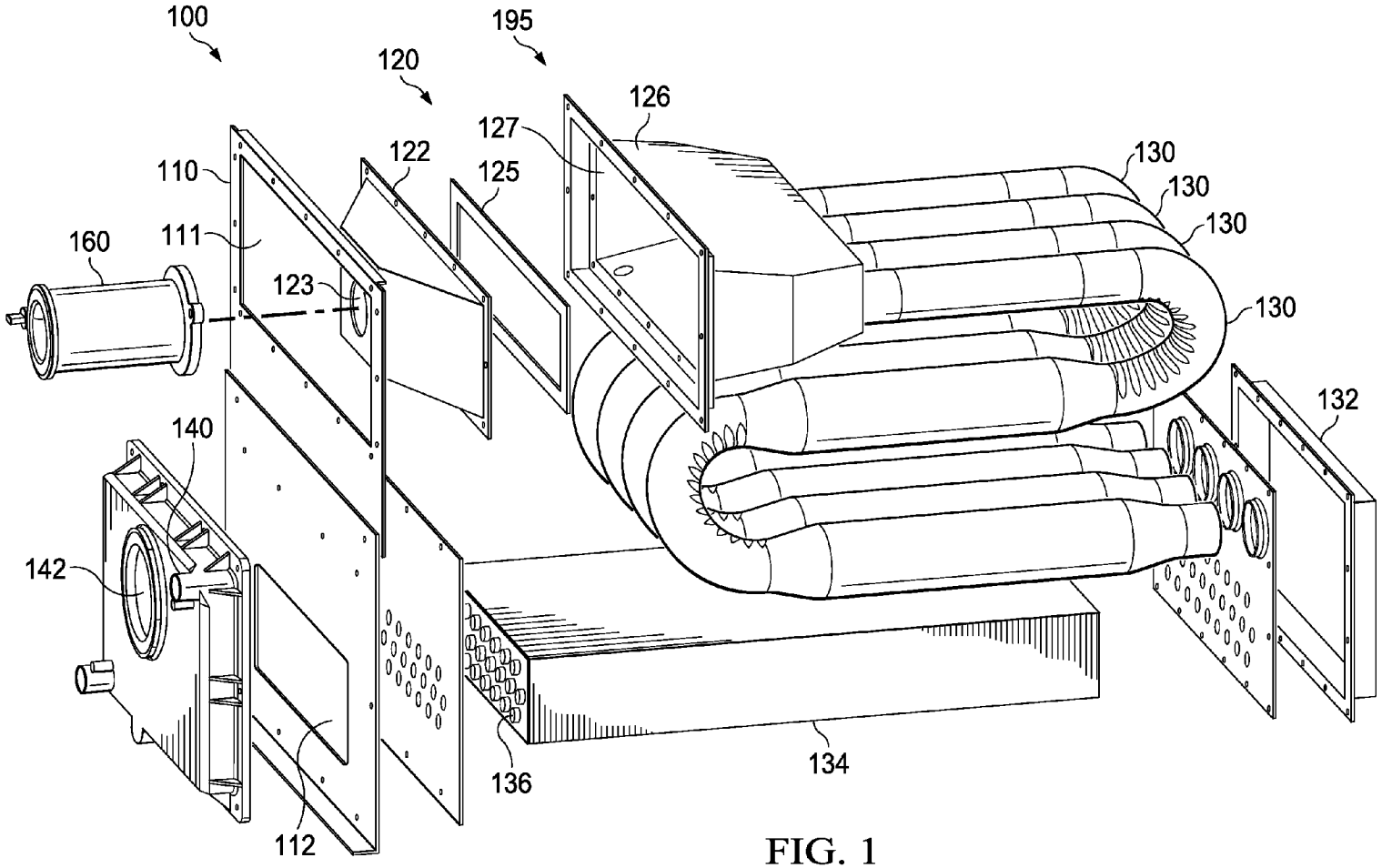
FIG. 1 is an oblique exploded view of a furnace according to an embodiment of the disclosure.
Figure 2:
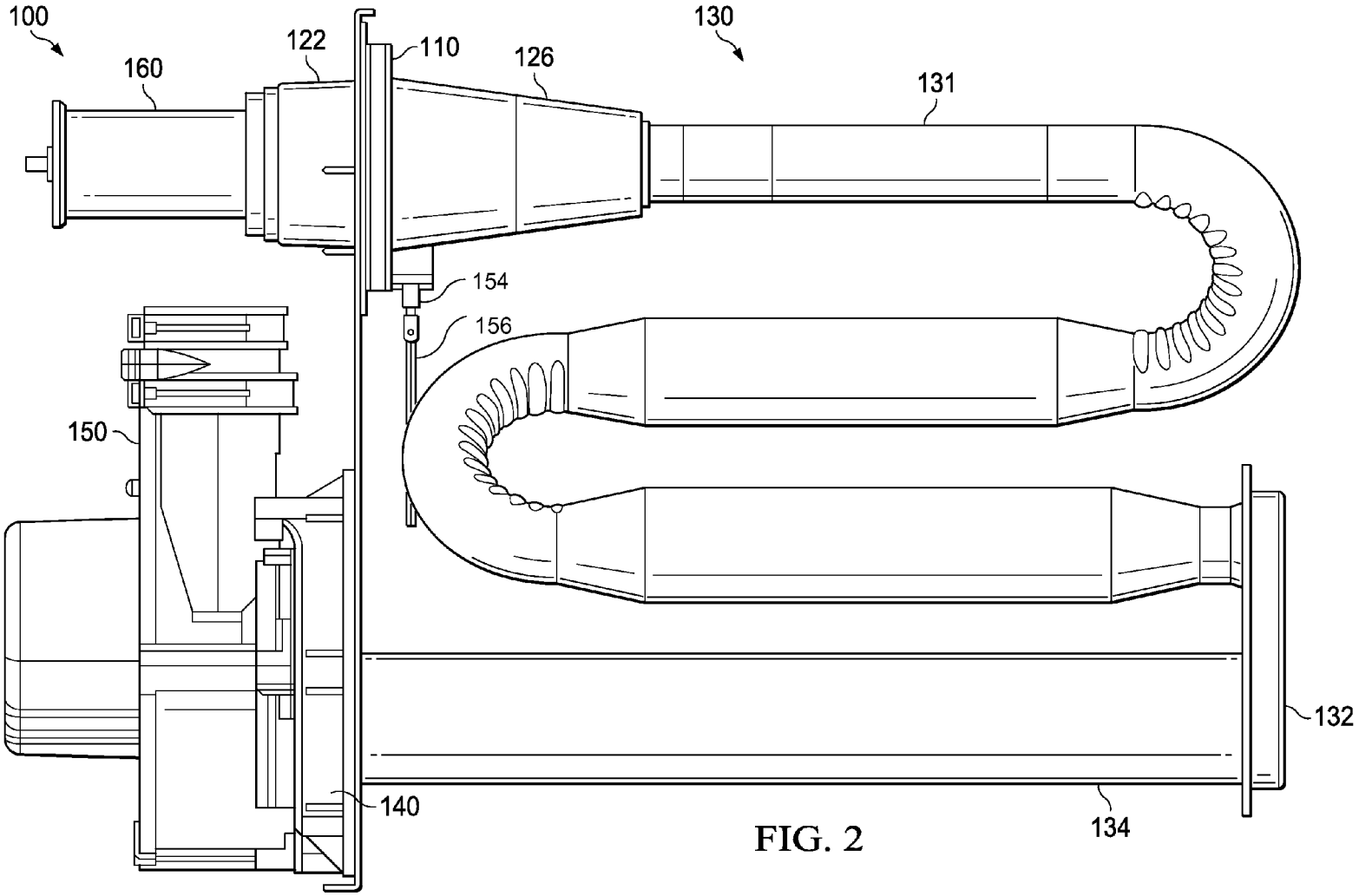
FIG. 2 is an orthogonal side view of the furnace of FIG. 1.

Referring to FIGS. 1 and 2, an oblique exploded view and an orthogonal side view of a furnace 100 are shown, respectively. The furnace 100 may comprise a partition panel 110, a mixture distributing box 122, a burner 125, a post-combustion chamber 126, at least one first or upstream heat exchanger 130, a manifold 132, a second or downstream heat exchanger 134, and a heat exchanger exhaust chamber 140. An intake assembly 195 may comprise a premixer 160, mixture distributing box 122, burner 125 and post-combustion chamber 126.

The mixture distributing box 122 may be mounted to the partition panel 110 so that an inlet 123 of distributing box 122 may direct an air-fuel mixture received from the premixer 160 to the burner 125. The mixture distributing box 122 may promote even distribution of the air-fuel mixture across a cross-sectional area of an air-fuel mixture flowpath and/or may promote even distribution of the air-fuel mixture across an upstream side of the burner 125. The mixing of the air and fuel prior to entering the distributing box 122 may be aided by a mixing device such as the premixer 160 (see FIG. 2) to promote homogenous mixing of the air and fuel prior to entering the mixture distributing box 122, as will be discussed further herein.

In some embodiments, the burner 125 may extend across substantially an entire cross-sectional area of the air-fuel mixture flowpath. The air-fuel mixture may flow from the mixture distributing box 122 through the burner 125 and into the post-combustion chamber 126. The burner 125 may be permeable, such as to allow the air-fuel mixture to travel through the burner 125 without a substantial pressure drop across the burner 125. For example, the burner 125 may comprise a great number of small perforations over a substantial portion of the upstream and downstream sides of the burner 125. Alternatively, a substantial portion of the upstream and downstream sides of the burner 125 may comprise one or more layers of woven material configured to allow the air-fuel mixture to flow therethrough. Still further, in other alternative embodiments, the burner 125 may comprise a combination of both perforations and woven material.

The burner 125 may be received within a cavity formed by the coupling of the mixture distributing box 122 and the post-combustion chamber 126. In some embodiments, a flange 129 of the burner 125 may be sandwiched between the mixture distributing box 122 and the post-combustion chamber 126 so that substantially all of the air-fuel mixture may pass through the burner 125 prior to exiting the above-described cavity. When the burner 125 is received within the above-described cavity the upstream side of the burner 125 may face the mixture distributing box 122 and an opposing downstream side of the burner 125 may face the post-combustion chamber 126. Post-combustion chamber 126 may be configured to output the combusted air-fuel mixture into multiple parallel flowpaths, as will be discussed further herein.

The one or more upstream heat exchangers 130 may be configured to receive an at least partially combusted air-fuel mixture downstream of the burner 125 and each upstream heat exchanger 130 may form a separate flowpath downstream relative to the burner 125. The downstream heat exchanger 134 may be configured to receive the at least partially combusted air-fuel mixture from the upstream heat exchangers 130. Heat exchanger 134 may comprise a fin-tube type heat exchanger and/or plate-fin type heat exchanger, either of which may comprise one or more tubes 136. In other embodiments, the heat exchanger may comprise a so-called clamshell heat exchanger.

In some embodiments, the at least partially combusted air-fuel mixture may be transferred from the one or more upstream heat exchangers 130 to downstream heat exchanger 134 through the manifold 132. While furnace 100 is described above as comprising one burner 125, alternative furnace embodiments may comprise more than one burner 125. In some cases, additional burners 125 may be utilized to increase an overall heating capacity. In some embodiments, several burners 125 may be aligned in parallel, so that multiple parallel air-fuel mixture flowpaths may be formed. Further, while furnace 100 is disclosed as comprising at least one upstream heat exchanger 130 and a downstream heat exchanger 134, alternative furnace embodiments may comprise only one upstream heat exchanger no downstream heat exchanger 134, and/or multiple downstream heat exchangers 134.

An igniter 154 (see FIG. 2) may be mounted partially within the post-combustion chamber 126 proximal to the downstream side of the burner 125 to ignite the air-fuel mixture a short distance downstream from the downstream side of the burner 125. The air-fuel mixture may be moved in an induced draft manner by pulling the air-fuel mixture through the furnace 100 and/or in a forced draft manner by pushing the air-fuel mixture through the furnace 100. The induced draft may be produced by attaching a blower and/or fan downstream, such as inducer blower 150 (see FIG. 2) relative to the heat exchanger exhaust chamber 140 and pulling the air-fuel mixture out of the system by creating a lower pressure at the exhaust of the heat exchanger exhaust chamber 140 as compared to the pressure upstream of the burner 125. Inducing flow in the above-described manner may protect against leaking the at least partially combusted air-fuel mixture and related products of combustion to the surrounding environment by ensuring the at least partially combusted air-fuel mixture is maintained at a pressure lower than the air pressure surrounding the furnace 100. With such an induced flow, any leak along the flowpath of the air-fuel mixture may result in pulling environmental air into the flowpath rather than expelling the at least partially combusted air-fuel mixture and related products of combustion to the environment. In alternative embodiments, the air-fuel mixture may be forced along the air-fuel mixture flowpath by placing a blower or fan upstream relative to the burner 125 and creating higher pressure upstream of the burner 125 relative to a lower pressure at the exhaust of the heat exchanger exhaust chamber 140. In some embodiments, a control system may control the inducer blower 150 to an appropriate speed to achieve desired fluid flow rates for a desired firing rate through the burner 125. Increasing the speed of the inducer blower 150 may introduce more air to the air-fuel mixture, thereby changing the characteristics of the combustion achieved by the burner 125. In some embodiments, a so-called zero governor regulator and/or zero governor gas valve may be additionally utilized to provide a desired fuel to air ratio in spite of the varying effects of an induced draft and/or other pressure variations that may fluctuate and/or otherwise tend to cause dispensing or more or less fuel in response to the pressure variations and/or negative pressures relative to atmospheric pressure.

Substantially enclosing the burner 125 within a cavity formed by the connecting of the mixture distributing box 122 and the post-combustion chamber 126 and substantially combusting the air-fuel mixture near the burner 125 may reduce the surface temperatures of the post-combustion chamber 126 and upstream heat exchangers 130 as compared to embodiments utilizing other types of burners. While the downstream side of the burner 125 is disclosed as facing the post-combustion chamber 126 while the upstream side of the burner 125 faces the mixture distributing box 122, in alternative embodiments, the burner 125 may be positioned differently and/or the flow of the air-fuel mixture may be passed through the burner 125 in a different manner. The post-combustion chamber 126 may be connected to the upstream heat exchangers 130 so that the at least partially combusted air-fuel mixture enters directly into the upstream heat exchangers 130, as will be discussed further herein. The post-combustion chamber 126 may seal the air-fuel mixture flowpath from secondary dilution air as well as position the burner 125 in a manner conducive for transferring the at least partially combusted air-fuel mixture to the upstream heat exchangers 130. While the upstream heat exchangers 130 are disclosed as comprising a plurality of tubes, in alternative embodiments, the upstream heat exchangers may comprise clamshell heat exchangers, drum heat exchangers, shell and tube type heat exchangers, and/or any other suitable type of heat exchanger.

Referring now to FIG. 2, the furnace 100 is shown as comprising the inducer blower 150, the air-fuel premixer 160, the igniter 154, and the flame sensor 156. Premixer 160 may comprise a Venturi style air-fuel mixer or any other suitable style of air-fuel mixers. The igniter 154 may comprise a pilot light, a spark igniter, a piezoelectric device, and/or a hot surface igniter. The igniter 154 may be controlled by a control system and/or may be manually ignited. The flame sensor 156 may comprise a thermocouple, a flame rectification device, and/or any other suitable safety device.

Figure 3:
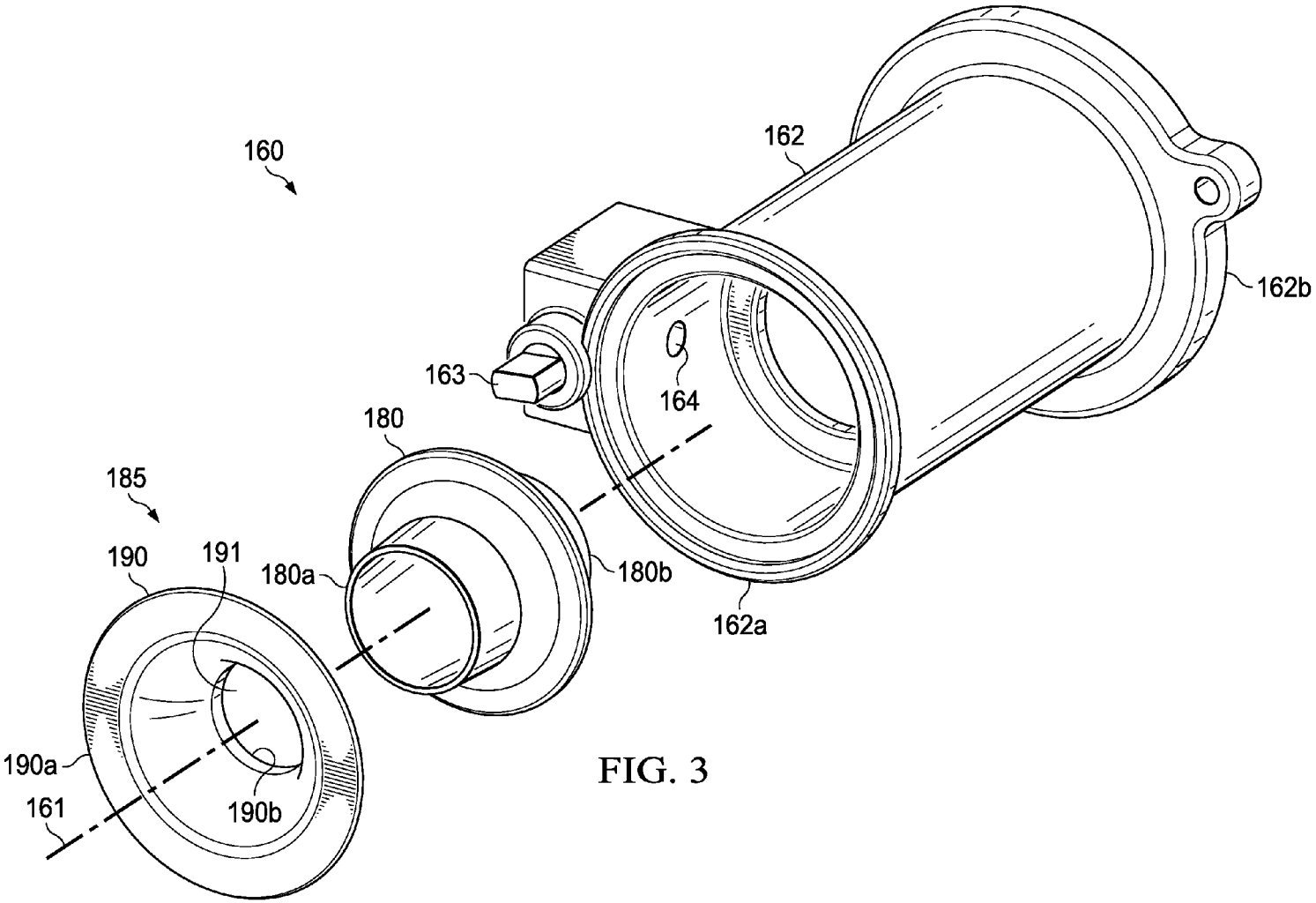
FIG. 3 is an oblique exploded view of a venturi premixer of the furnace of FIG. 1.

Referring now to FIG. 3, an oblique exploded view of a venturi mixer or premixer 160 is shown. The premixer 160 may comprise a central or longitudinal axis 161 and comprise an outer tube 162 and a venturi 185, which may comprise a diffuser or lower portion 180 and an upper portion 190. Upper portion 190 may comprise a first end 190*a*, second end 190*b* and a central or longitudinal axis concentric with axis 161. Upper portion 190 may also comprise an inner surface 192 that defines a bore 193. The inner surface 192 may be configured such that the radius of bore 193 decreases logarithmically moving from first end 190*a* towards second end 190*b*. Lower portion 180 may comprise a first end 180*a*, a second end 180*b* and a central or longitudinal axis concentric with axis 161. Lower portion 180 may also comprise an inner surface 182 that defines a bore 183 having a diameter 183*a* at second end 180*b*. The inner surface 182 may be configured that the radius of bore 182 increases linearly moving from first end 180*a* towards second end 180*b*.

The outer tube 162 may comprise a first end 162*a*, second end 162*b*, a fuel injector 163 and a port 164 providing fluid communication between injector 163 and the interior of the tube 162. Premixer 160 may be configured to provide for mixing between fuel from injector 163 and air, which may enter premixer 160 via a bore 193 that may be formed within upper portion 190 of venturi 185. The effective and thorough mixing of air and fuel within premixer 160 may allow for more efficient burning of the air-fuel mixture by a burner (e.g., burner 125 of FIG. 1), in turn providing for relatively fewer emissions as the mixture is burned.

Referring now to FIGS. 4A-4D, an orthogonal front view, two orthogonal cut-away views (the first along lines A-A and the second along lines B-B), and an orthogonal bottom view of the premixer 160 are shown, respectively. The tube 162 may comprise an inner surface 165 that defines a bore 167 having a diameter 167*a*. A flange 166 may extend radially inward from inner surface 165 and into bore 167. The lower portion 180 of venturi 185 may be disposed within bore 167 and comprise a flange 184 that extends radially outward from an outer surface 181 of lower portion 180. A lower radial surface 184*a* of flange 184 may physically engage an upper radial surface 166*a* of flange 166. The physical engagement between flange 184 of lower portion 180 and flange 166 of tube 162 may seal or at least substantially restrict fluid flow between surfaces 184*a* and 166*a*. Thus, engagement between flanges 184 and 166 may divide bore 167 into an upper section 167*b* and a lower section 167*c*. Fluid communication between sections 167*b* and 167*c* may be provided for via a bore 183 of lower portion 180.

Tube 162 may further comprise an upper flange 168 at upper end 162*b*. Upper portion 190 of venturi 185 may comprise a flange 194 at first end 190*a* that extends radially outward from an outer surface 193 of upper portion 190. Upper portion 190 of venturi 185 may be disposed within bore 167 of tube 162 such that a lower radial surface 168*a* of the flange 168 of tube 162 may engage an upper radial surface 194*a* of the flange 194 of upper portion 190. The physical engagement between flange 194 of upper portion 190 and flange 168 of tube 162 may seal or restrict fluid flow between surfaces 194*a* and 168*a*. Fluid communication between the area exterior of premixer 160 and bore 167 (e.g., section 167*c*) may be provided for via bore 193 of upper portion 190.

Lower portion 180 and upper portion 190 of venturi 185 may be axially positioned relative to each other within bore 167 such that second end 190*b* of upper portion 190 may extend partially into bore 183 of lower portion 180, providing a gap 186 between outer surface 193 of upper portion 190 and inner surface 182 of lower portion 180. Thus, a path of fluid communication may be provided between section 167*b* of the bore 167 of tube 162 and bore 183 of lower portion 180 via gap 186. Also, flange 184 of lower portion 180 may be positioned on the outer surface 181 such that second end 180*b* extends partially into lower section 167*c* of the bore 167 of tube 162.

Figure 4A:
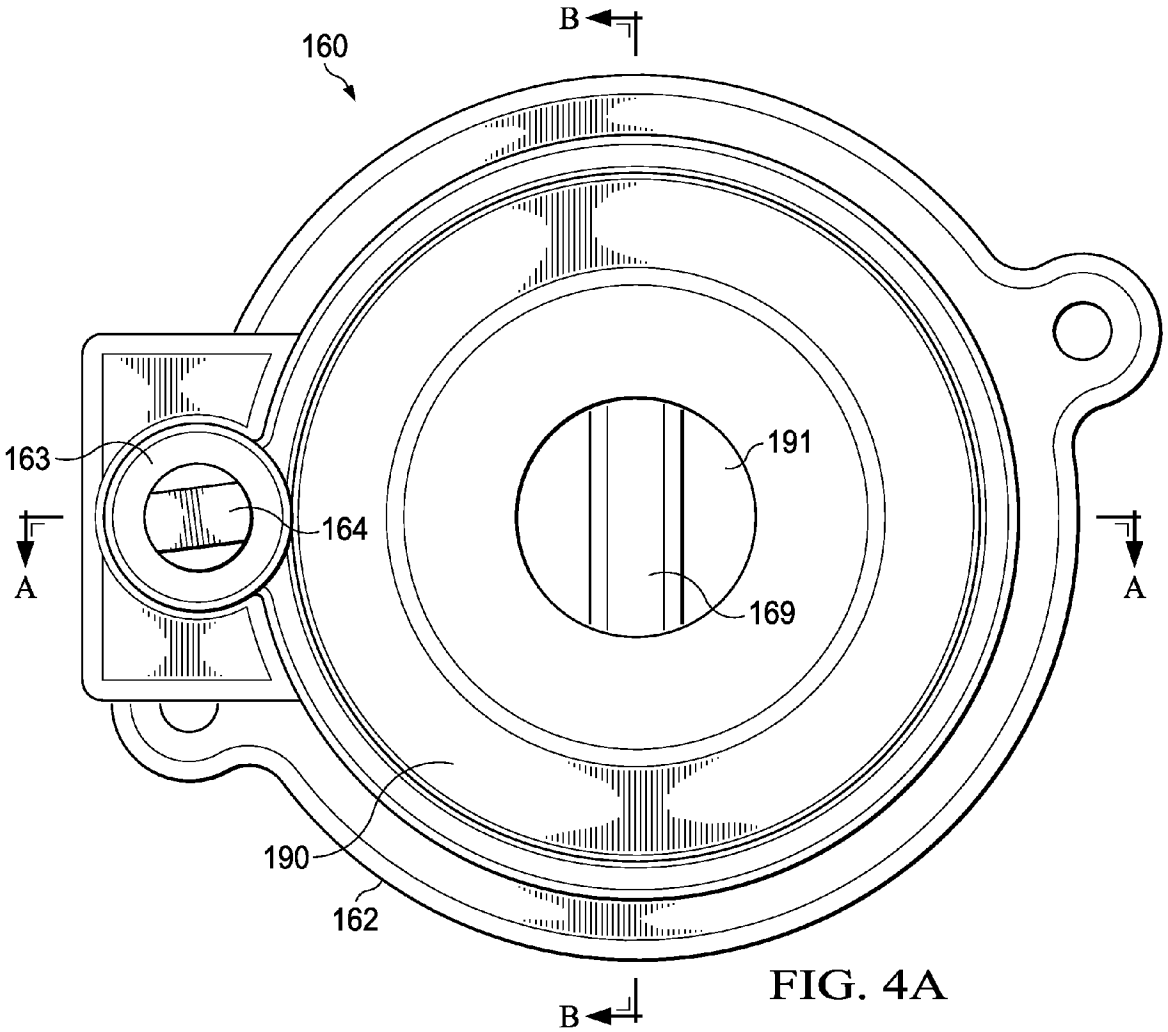
FIG. 4A is an orthogonal front view of the premixer of FIG. 3.
Figure 4B:
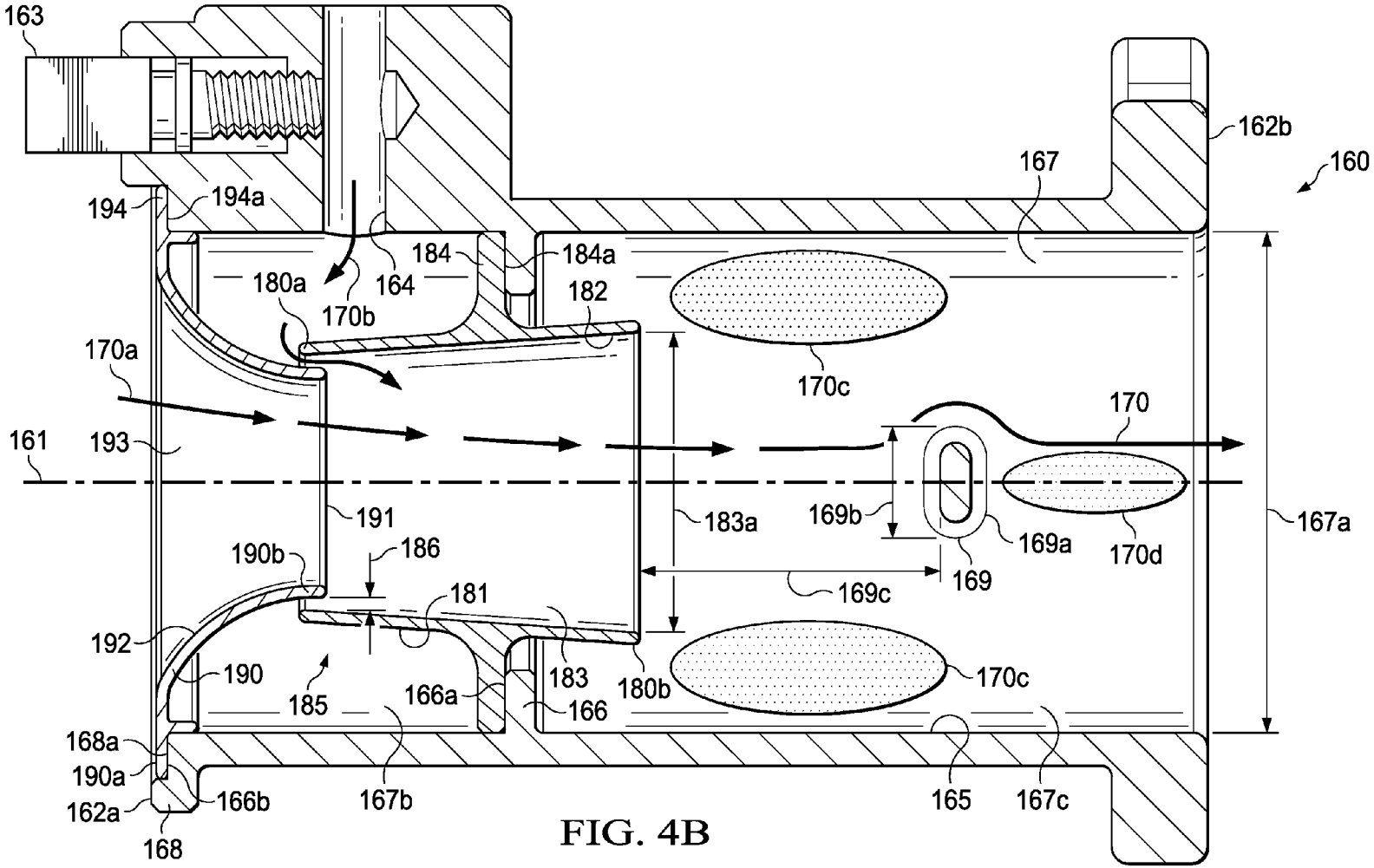
FIG. 4B is an orthogonal cut-away top view along lines A-A of the premixer of FIG. 4A.
Figure 4C:
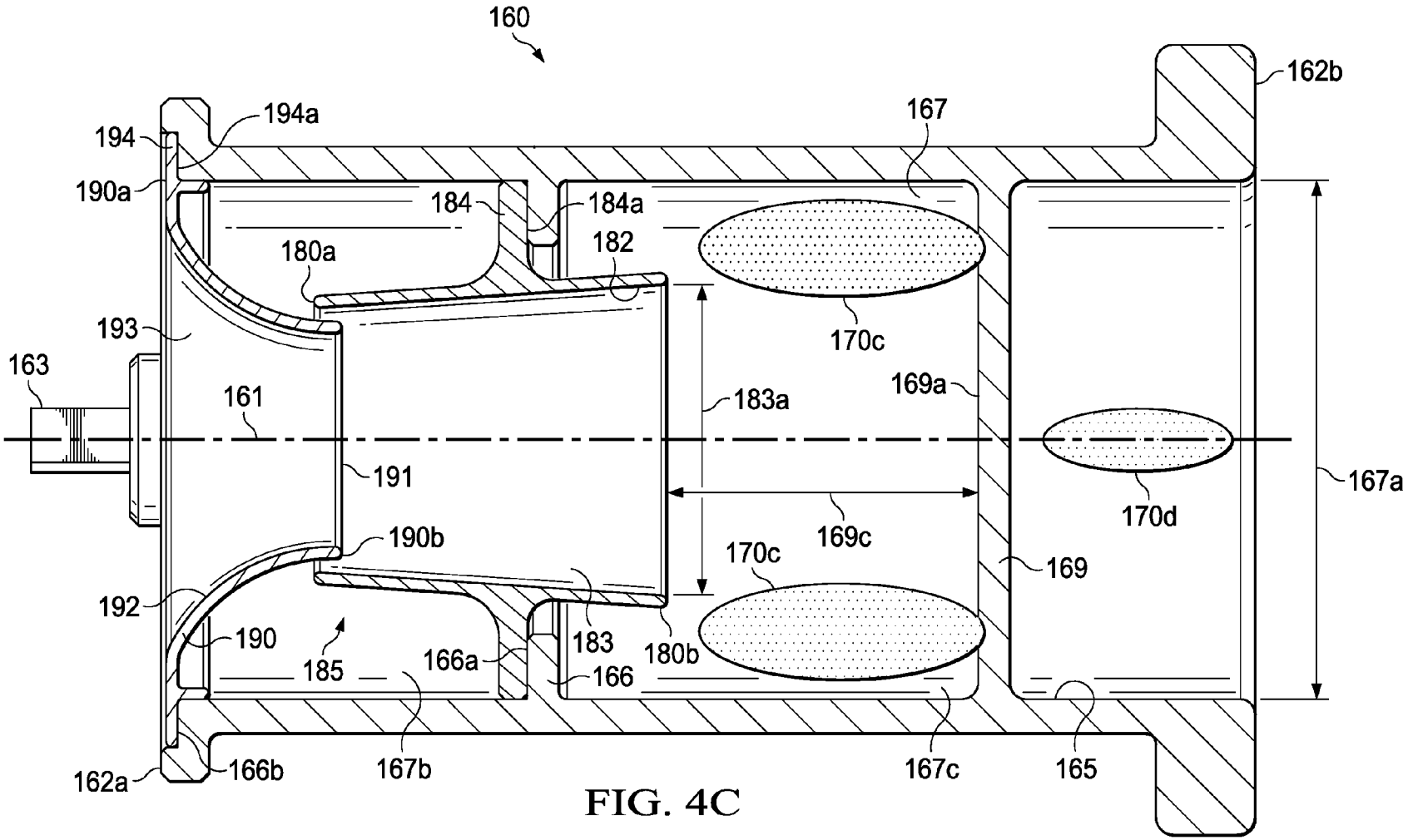
FIG. 4C is an orthogonal cut-away side view along lines B-B of the premixer of FIG. 4A.

Tube 162 may further comprise a disturber 169 in the form of a longitudinal member disposed axially between second end 180*b* of the lower portion 180 of venturi 185 and second end 162*b*. Disturber 169 may be configured to disturb or obstruct a fluid that is flowing axially from first end 162*a* towards second end 162*b* of tube 162. Disturber 169 may also be configured to shape a velocity profile of the air-fuel mixture by creating additional mixing zones towards the center of the fluid flow downstream of the disturber 169. Disturber 169 may comprise an outer surface 169*a* having a width 169*b* (as shown in FIG. 4B) and may extend radially across bore 167 to contact inner surface 165 (as shown in FIG. 4B) of tube 162 at diametrically opposed locations (as shown in FIG. 4C). Further, disturber 169 may be positioned within bore 167 such that it intersects axis 161 of premixer 160. The outer surface 169*a* of disturber 169 may be positioned at an axial distance 169*c* from second end 180*b* of lower portion 180. The width 169*b* of disturber 169 and the axial distance 169*c* may be a function of the diameter 167*a* of bore 167 and the diameter 183*a* of bore 183 at second end 180*b* of lower portion 180. For instance, the length scale for a mixing zone height ($H_{mix}$) may be defined as being equal to half the difference between diameter 167*a* ($D_{tube}$) and diameter 183*a* ($D_{diff}$):

$$H_{mix}=(D_{tube}-D_{diff})/2$$

Figure 4D:
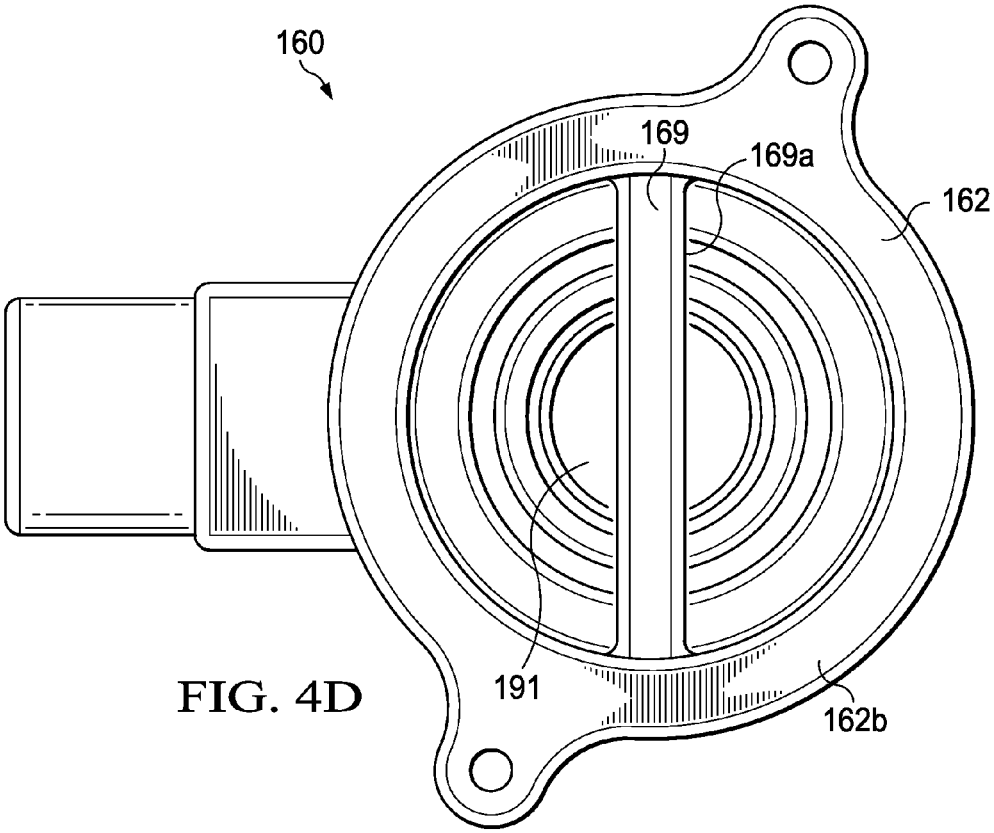
FIG. 4D is an orthogonal bottom view of the premixer of FIG. 3.

In the embodiment of FIGS. 3-4D: the ratio of $D_{tube}$ over $D_{diff}$ (i.e., $D_{tube}/D_{diff}$) may have a value in the range of about 1.2 to 4; the ratio of axial distance 169*c* (L) over $H_{mix}$ (i.e., $L/H_{mix}$) may have a value in the range of about 1 to 15; and the ratio of width 169*b* (W) over $D_{diff}$ (i.e., $W/D_{diff}$) may have a value in the range of about 0.1 to about 1.1. Disturber 169 and distance 169*c* may be configured to enhance mixing of an at least partially mixed air-fuel mixture flowing toward disturber 169 from bore 183 of lower portion 180. However, distance 169*c* may be different depending upon the application (e.g., degree of pressure differential, type of fuel used, size of premixer, etc.). For example, in some embodiments, $D_{tube}/D_{diff}$ may equal 1.6, $L/H_{mix}$ may equal 3, and $W/D_{diff}$ may equal 0.3.

An air-fuel mixture flowpath 170 may be created by inducing a relatively lower pressure at end 162*b* of tube 160 (e.g., via a blower disposed downstream of mixer 160) such that air from an area exterior of premixer 160 may enter bore 193 of the upper portion 190 of venturi 185 and fuel from injector 163 may enter bore 167*c* of tube 162 via port 164. Thus, air-fuel mixture flowpath 170 may be formed from the mixing of air from an air flowpath 170*a* and fuel from a fuel flowpath 170*b* within bore 167 and venturi 185. Flowpath 170 may extend across disturber 169 and may be disturbed such that additional mixing of air and fuel may take place as a result of extending across disturber 169.

Flowpath 170 may also include upstream air-fuel mixing zones 170*c* disposed in section 167*c* upstream from disturber 169 and proximal to inner surface 165, which may allow for additional mixing of the air-fuel mixture within zones 170*c*. Mixing zones 170*c* may arise from the expansion in diameter between diameter 183*a* of lower portion 180 and diameter 167*a* of tube 160. Flowpath 170 may also include a downstream mixing zone 170*d* disposed within section 167*c* but downstream of disturber 169 and proximal to longitudinal axis 161, which may allow for additional mixing of the air-fuel mixture.

Figure 5A:
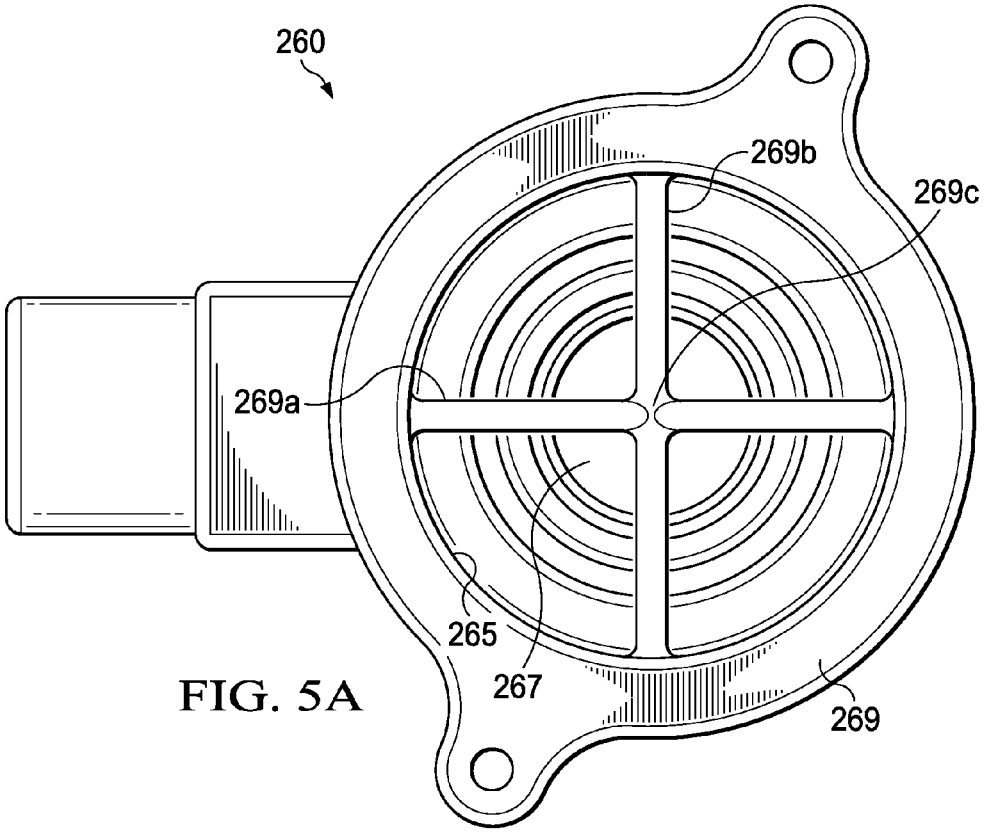
FIG. 5A is an orthogonal bottom view of a venturi premixer according to another embodiment of the disclosure.
Figure 5C:
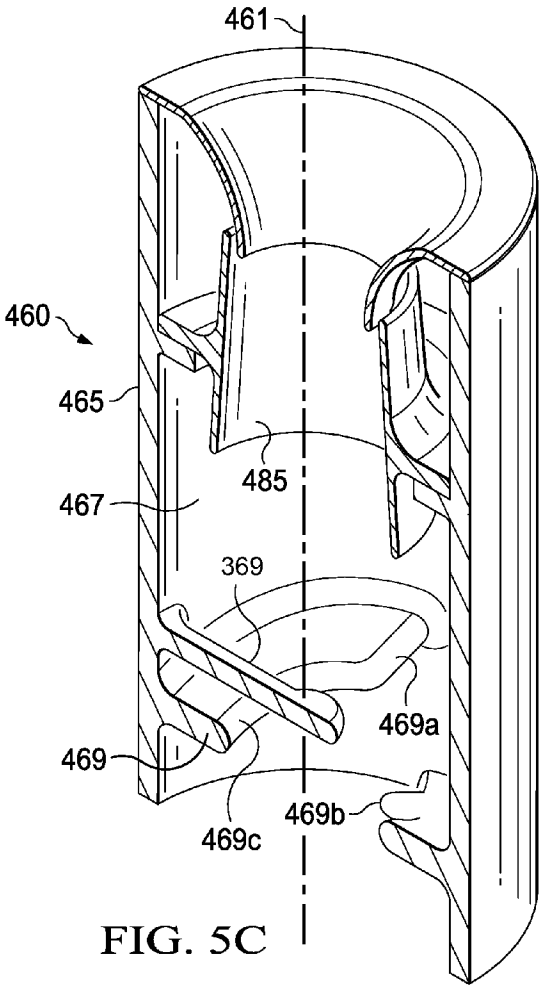
FIG. 5C is an oblique cut-away side view of a venturi premixer according to another embodiment of the disclosure.
Figure 5B:
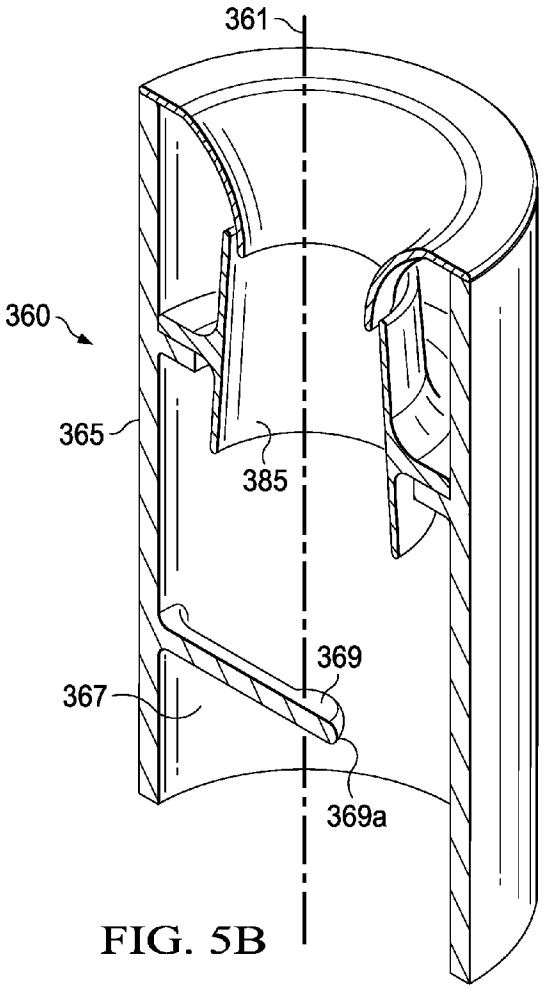
FIG. 5B is an oblique cut-away view of a venturi premixer according to another embodiment of the disclosure.

Referring now to FIGS. 5A-5C, several different embodiments of disturbers are shown. FIG. 5A is a bottom view illustrating an embodiment of a premixer 260 that may comprise a disturber 269 in the form of a cross-member. Disturber 269 may include two longitudinal members 269*a* and 269*b*, which may span across a bore 267 defined by an inner surface 265 to intersect at a central location 269*c*. FIG. 5B illustrates another embodiment of a premixer 360 that includes a disturber 369 in the form of a tab member disposed below a venturi 385. Disturber 369 may extend partially into a bore 367 from an inner surface 365 of premixer 360. Thus, disturber 369 may extend radially through an axis 361 of premixer 360 and terminate at a terminal end 369*a*. FIG. 5C illustrates another embodiment of a premixer 460 that may comprise a disturber 369 and a disturber 469 disposed axially below disturber 369. Disturber 469 may be a helical member and may extend both axially within premixer 460 and radially into a bore 467 from an inner surface 465 of premixer 460. Also, disturber 469 may protrude helically from inner surface 465 between a first end 469*a* and a second end 469*b*.

Figure 6:
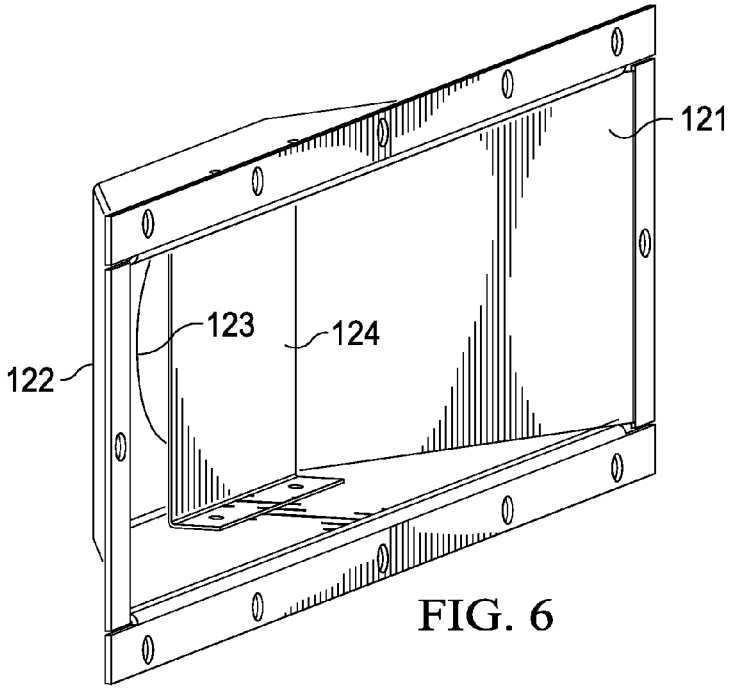
FIG. 6 is an oblique view of a mixture distributing box of the furnace of FIG. 1.

Referring now to FIG. 6, an oblique view of mixture distributing box 122 is shown. The mixture distributing box 122 may comprise an inlet 123 and a deflector 124. Deflector 124 may be connected to and received within mixture distributing box 122. The shape and positioning of deflector 124 within mixture distributing box 122 with respect to inlet 123 may be configured to promote even distribution of the air-fuel mixture entering mixture distributing box 122 over a cross-sectional area of the flowpath of the air-fuel mixture and/or to promote even distribution of the air-fuel mixture over an upstream side of the burner 125 disposed downstream of the deflector 124. The above-described increased even distributions of the air-fuel mixture may promote a more homogenous temperature distribution within the post-combustion chamber 126 and/or the upstream heat exchangers 130. While deflector 124 is shown as comprising a rectangular plate with an upstream side facing inlet 123, in alternative embodiments, a deflector may comprise any another shape and/or device configured to disturb fluid flow entering mixture distributing box 122.

Figure 7:
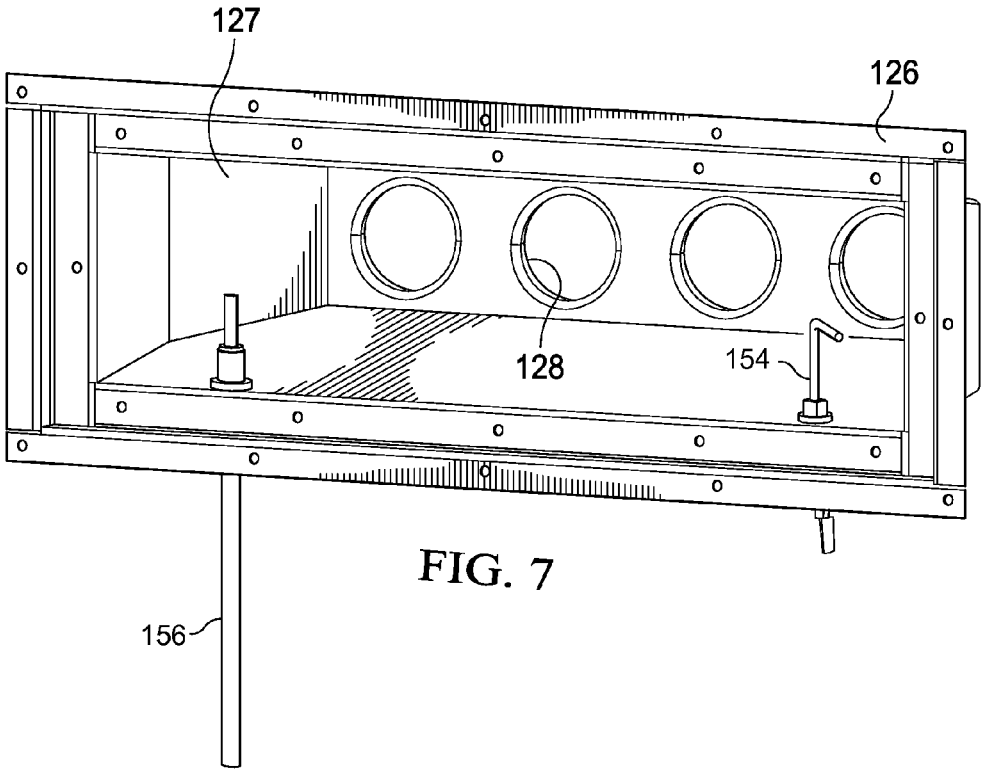
FIG. 7 is an oblique view of a post-combustion chamber of the furnace of FIG. 1.

Referring now to FIG. 7, an oblique view of post-combustion chamber 126 is shown. In this embodiment, igniter 154 and flame sensor 156 are disposed within an inlet 127 of post-combustion chamber 126. Post-combustion chamber 126 may further comprise a plurality of outlets 128 that may be configured to directly couple to the upstream heat exchangers 130. Burner 125 may be disposed upstream of post-combustion chamber 126, an inputted air-fuel mixture may be ignited by igniter 154, and the at least partially combusted air-fuel mixture may pass through a substantially undivided space of the post-combustion chamber 126 prior to passing into a plurality of separate flowpaths via outlets 128.

Figure 8A:
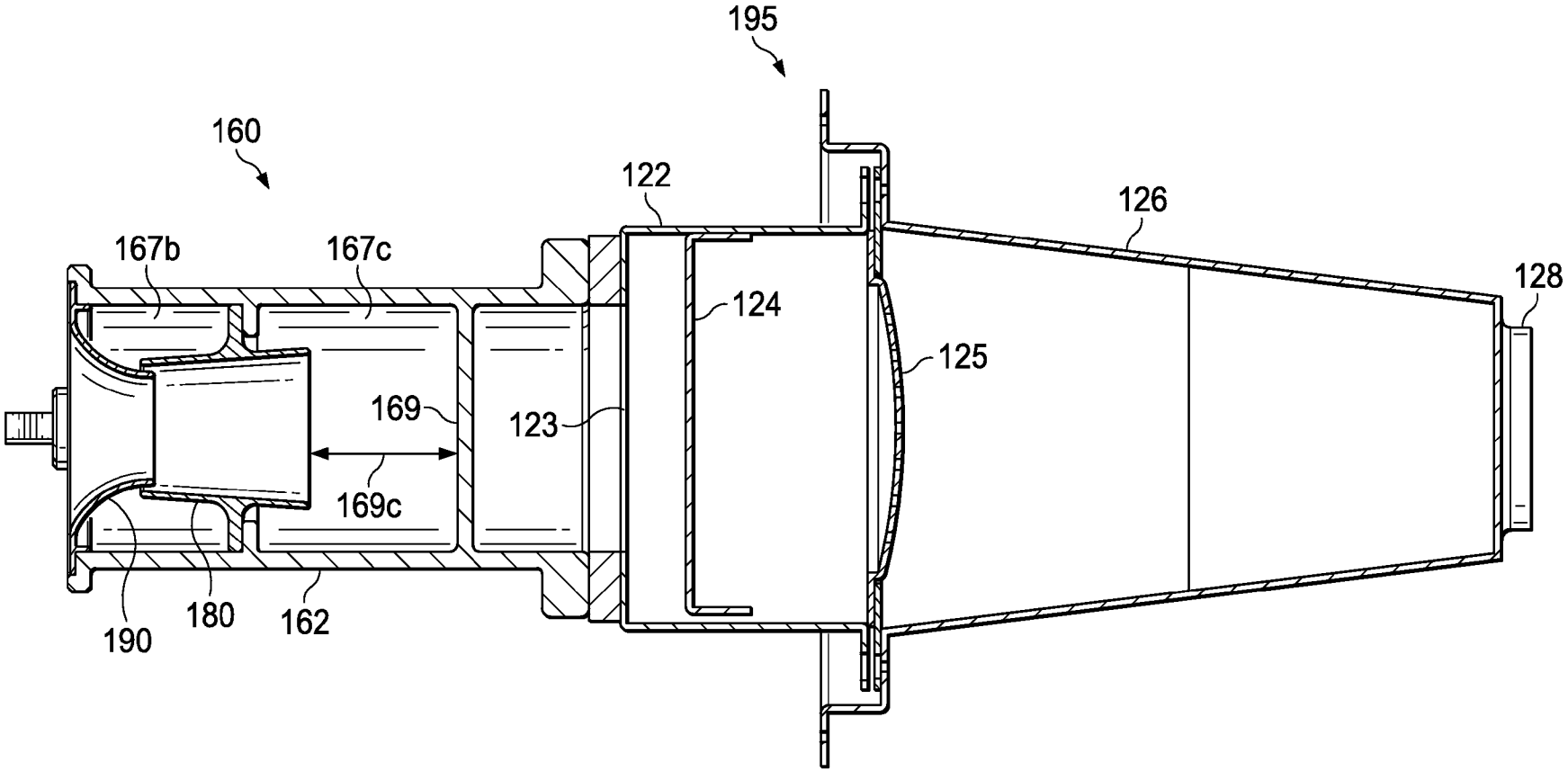
FIG. 8A is an orthogonal cut-away view of an intake assembly of the furnace of FIG. 1.
Figure 8B:
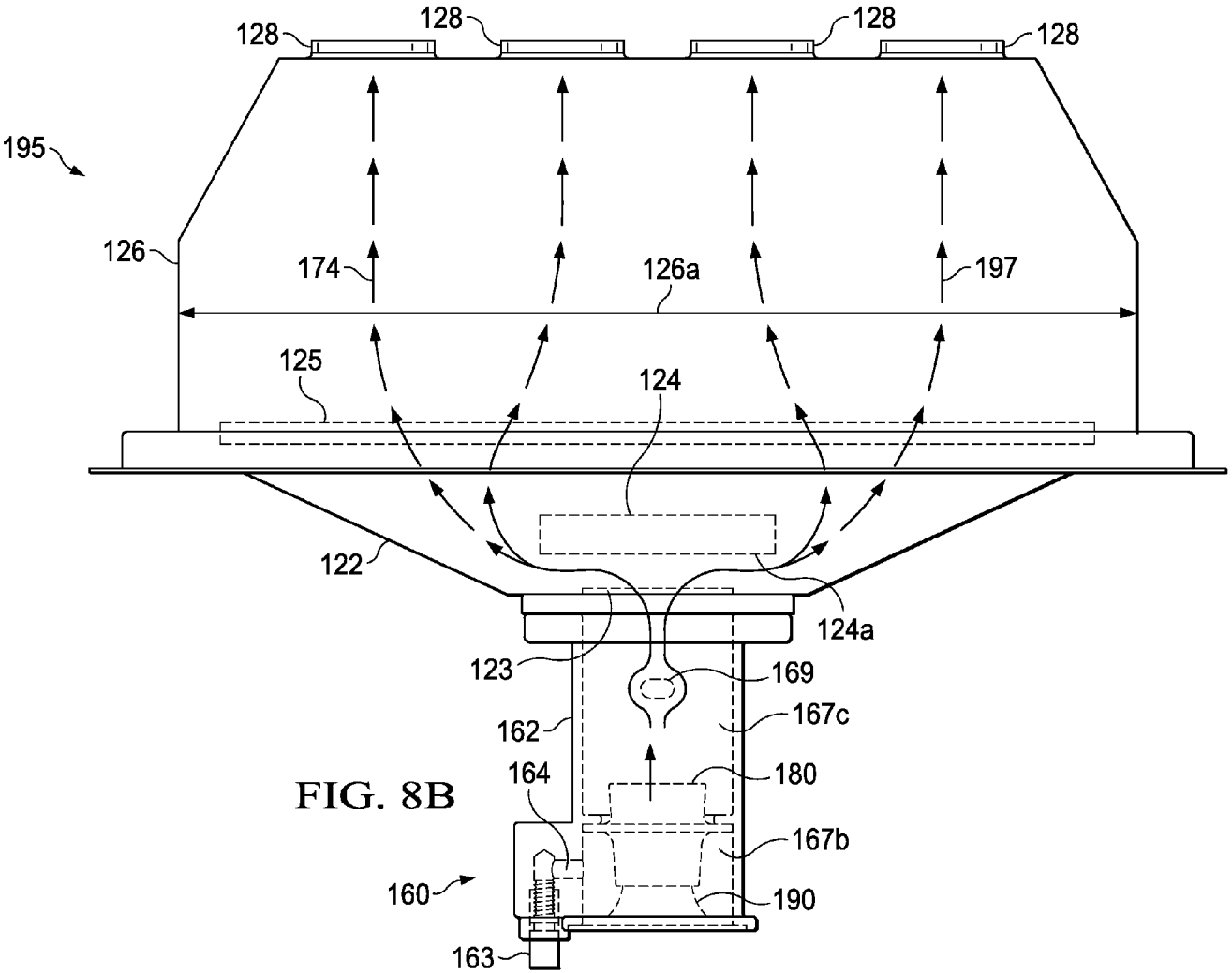
FIG. 8B is a schematic top view of the intake assembly of FIG. 8A.

Referring now to FIGS. 8A and 8B, an orthogonal cut-away side view and an orthogonal cut-away top view, respectively, are shown of an intake assembly 195. An intake flowpath 197 (as shown in FIG. 8B) may generally illustrate a flow of an air-fuel mixture within intake assembly 195 which may be caused by providing a pressure difference between outlets 128 of post-combustion chamber 126 and first end 162*a* of premixer 160. Intake flowpath 197 may extend through premixer 160 and may be disturbed via disturber 169, which may result in additional mixing of air and fuel within the intake assembly 195. As the flowpath 197 enters mixture distributing box 122 via inlet 123 it may be deflected by deflector 124, which may aid in distributing fluid within intake assembly 195 across a width 126*a* (see FIG. 8B) of the mixture distributing box 122 before entering the plurality of outlets 128. Following the exit of post-combustion chamber 126 via the plurality of outlets 128, intake flowpath 197 may extend into a plurality of heat exchanger tubes of heat exchangers 130.

Figure 9:
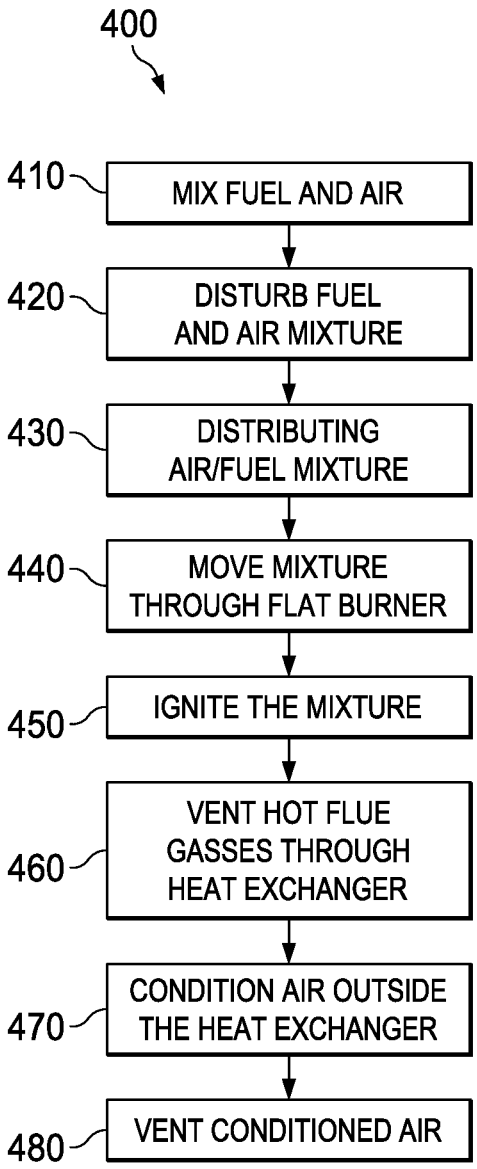
FIG. 9 is a flowchart of a method of operating a furnace according to an embodiment of the disclosure.

Referring now to FIG. 9, a block diagram depicting a method 400 of operating a furnace is shown. The method may begin at block 410 by mixing a fuel and air together. An air-fuel mixer and/or so-called premixer, such as premixer 160, may be utilized to accomplish the mixing of the fuel and the air. The fuel may comprise natural gas available from a gas valve attached to a mixture distributing box, such as mixture distributing box 122, or to an air-fuel premixer upstream of the mixture distributing box. Alternatively, the fuel may comprise propane and/or any other suitable fuel. The air may be introduced to the mixture distributing box or to the air-fuel mixer by a so-called forced draft or a so-called induced draft.

The method 400 may continue at block 420 where the air-fuel mixture may be disturbed via a disturber, such as disturber 169, positioned at least partially within the air-fuel mixture flowpath, such as intake flowpath 197. The disturber may be positioned within a tube downstream of the air-fuel mixer and/or so-called premixer and may additionally mix the air and fuel within a flowpath or flowspace disposed downstream of the mixer. The disturber may take the form of a longitudinal member extending radially across at least a portion of the flowpath or flowspace, however, in other embodiments, the disturber may take other forms (e.g., a tab, a helical member, etc.).

The method 400 may continue at block 430 where the air-fuel mixture may pass through a mixture distributing box to be more evenly distributed across an upstream side of a burner, such as burner 125. The mixing process may be aided by a deflector located within the mixture distributing box that may comprise the effect of deflecting or disturbing the flow of the air-fuel mixture. For example, the deflector may be placed in front of the outlet of the air-fuel mixing box, altering the flow of the air and fuel within the air-fuel mixing box and thereby causing the air-fuel mixture to be more evenly distributed across a cross-sectional area of the air-fuel mixture flowpath.

The method 400 may continue at block 440 where the air-fuel mixture may be moved through a burner. The burner may comprise a thin and elongate body with an upstream side and a downstream side. The upstream side and downstream side of the burner may be permeable to allow the air-fuel mixture to pass through the burner. For example, the burner may comprise a great number of small perforations and/or a woven material over a substantial portion of the upstream and downstream sides of the burner. Further, the burner may be contained within a cavity comprising internal space of a mixture distributing box and internal space of a post-combustion chamber so that the air-fuel mixture leaving the air-fuel mixture distribution box passes through the upstream and downstream sides of the burner.

The method 400 may continue at block 450, where the air-fuel mixture may be ignited. The downstream side of the burner may face the post-combustion chamber. An igniter may be mounted in the post-combustion chamber near the downstream side of the burner. The igniter may comprise a pilot light, a piezoelectric spark, or a hot surface igniter. As the air-fuel mixture may pass through the burner, the igniter may ignite and cause at least partial combustion of the air-fuel mixture to begin near the downstream side of the burner.

The method 400 may continue at block 460 by directing the at least partially combusted air-fuel mixture into a heat exchanger, such as heat exchanger 130. Combustion may at least partially occur near the downstream side of the burner so that heat is generated and forced downstream of the burner and into the post-combustion chamber. In this embodiment, the combustion may occur generally at or near the downstream side of the burner. In alternative embodiments, combustion may occur both at the upstream and downstream sides of the burner as well as within an interior of the burner. The post-combustion chamber may be configured to divide a single flowpath associated with the burner into multiple parallel flowpaths. One or more of the multiple parallel flowpaths may extend through a heat exchanger. The heat exchangers may be tubular in design with an upstream end connected to the post-combustion chamber and a downstream end connected to either a heat exchanger exhaust chamber or to a manifold. An upstream end of a downstream heat exchanger may be connected to the manifold and a downstream end of the downstream heat exchanger may be connected to a heat exchanger exhaust chamber. A heat exchanger exhaust chamber may be disposed downstream from the heat exchanger(s) and may be configured to recombine the plurality of parallel flowpaths associated with the heat exchanger(s) into a single and/or fewer flowpaths. The at least partially combusted air-fuel mixture may comprise $NO_x$. The level of $NO_x$ in the at least partially combusted air-fuel mixture may be lowered by varying the combustion temperature of the air-fuel mixture and/or the ratio of air to fuel within the mixture.

The method 400 may continue at block 470 by conditioning air outside of the heat exchanger. As the at least partially combusted air-fuel mixture moves through the heat exchanger(s) toward the heat exchanger exhaust chamber, the heat exchanger(s) may be heated. Air that is exterior to the heat exchanger(s) may be moved into contact with the heat exchanger(s). As the air moves across the heat exchanger(s), heat may be transferred from the heat exchanger(s) to the air contacting the heat exchanger(s).

The method 400 may continue at block 480 by venting the conditioned air into an air conditioned space, for example, an office space or living area of a home. The heated air may be used to warm the space in order to increase comfort levels for occupants and/or to maintain the contents of the space at a pre-determined temperature.

Figure 10:
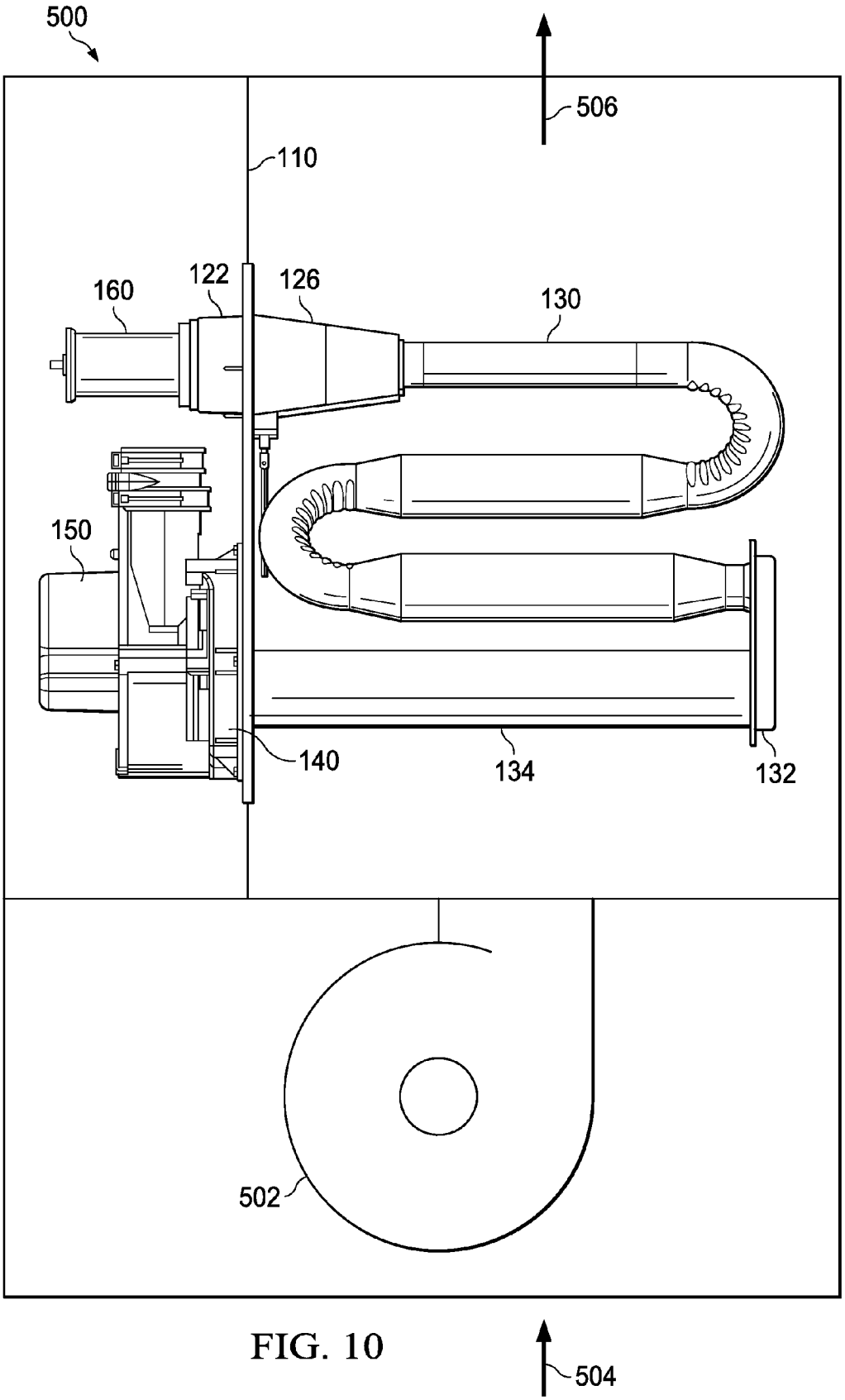
FIG. 10 is a schematic view of a furnace according to another embodiment of the disclosure.

Referring now to FIG. 10, a furnace 500 is shown. Furnace 500 may comprise a circulation air blower 502 that receives incoming airflow 504 and passes incoming airflow 504 into contact with downstream heat exchanger 134 and upstream heat exchanger 130 to transfer heat from the heat exchangers 134, 130 to the air. Exiting airflow 506 may be distributed to an area that is to be conditioned with the heated air. A partition panel 110 may isolate the air-fuel mixture that may be at least partially combusted from the incoming and exiting airflows 504, 506. Due to a thin and elongate burner that may be disposed between the mixture distributing box 122 and post-combustion chamber 126, a size of the furnace 500 may be reduced relative to other furnaces that do not comprise a premix burner configured for use with an inducer draft.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A heating, ventilation, and/or air conditioning (HVAC) furnace, comprising:

a venturi premixer;

a disturber disposed downstream relative to the venturi premixer and in an undivided output of the venturi premixer.

a post-combustion chamber disposed downstream of the disturber and in fluid communication with the venture premixer, wherein the post-combustion chamber is configured to divide a single flowpath entering the post-combustion chamber into a plurality of parallel flowpaths exiting the post-combustion chamber; and a burner disposed downstream relative to the disturber;

wherein the disturber comprises a longitudinal member configured to generally bisect the output of the venture premixer.

2. The HVAC furnace of claim 1, wherein a mixture distributing box disposed upstream relative to the post-combustion chamber comprises a deflector.

3. The HVAC furnace of claim 1, further comprising:

a heat exchanger tube disposed downstream of the premixer and in fluid communication with the premixer.

4. The HVAC furnace of claim 1, further comprising:

a tube configured to receive the undivided output, wherein the disturber is at least partially disposed within the tube, and wherein the tube is configured to pass the undivided output through the tube in an undivided single flowpath.

5. The HVAC furnace of claim 1, wherein the disturber comprises a tab member.

6. The HVAC furnace of claim 1, wherein the disturber comprises a helical member.

7. The HVAC furnace of claim 1, further comprising an inducer blower disposed downstream relative to the disturber.

8. A receiving tube for a furnace, comprising:

a flowspace disposed within the receiving tube; and a disturber at least partially disposed within the flowspace, the disturber comprising a longitudinal member that extends radially across the flowspace to substantially bisect the flowspace;

wherein the flowspace is configured to be at least one of (1) directly connected to an output of a venturi premixer and (2) substantially enveloping an output of a venture premixer;

wherein the receiving tube is configured to allow passage of fluid therethrough in an undivided flowpath;

wherein the disturber is located upstream relative to a burner associated with the receiving tube; and wherein the disturber is located upstream of a post-combustion chamber that is configured to divide the undivided flowpath into a plurality of parallel flowpaths.

9. The receiving tube of claim 8, wherein the disturber is a cross-member that extends entirely radially across the flowspace.

10. The receiving tube of claim 8, wherein the disturber comprises a helical member.

11. The receiving tube of claim 8, wherein the disturber comprises a tab member that extends only partially across the flowspace.

12. The receiving tube of claim 8, wherein the disturber intersects a central axis of the receiving tube.

13. A method of operating a heating, ventilation, and/or air conditioning (HVAC) furnace, comprising:

mixing air and fuel using a venturi to generate an air-fuel mixture;

outputting the air-fuel mixture from the venturi into a receiving tube along an undivided flowpath;

disturbing the air-fuel mixture using a disturber disposed within the interior of the receiving tube,wherein the disturbing comprises bisecting the air-fuel mixture prior to combustion of the air-fuel mixture; and outputting the disturbed air-fuel mixture from the venturi along the undivided flowpath.

14. The method of claim 13, wherein the disturber disturbs the air-fuel mixture upstream of a division of the undivided flowpath into a plurality of parallel flowpaths.

15. The method of claim 13, further comprising:

combining the plurality of flowpaths at a location downstream relative to the division of the undivided flowpath.

16. The method of claim 13, further comprising inducing a negative draft using an inducer blower disposed downstream from the disturber.

17. The method of claim 13, wherein disturbing the air-fuel mixture using a disturber disposed within the interior of the receiving tube comprises creating an air-fuel mixing zone downstream of the disturber.

* * * * *